US005984566A

United States Patent [19]

Blaha

[11] Patent Number: 5,984,566

[45] Date of Patent: Nov. 16, 1999

[54] BRACKET FOR JOINING TABLES AND/OR TABLE TOPS

[76] Inventor: Friedrich Blaha, Kleinengersdorfer Strasse 100, 2100 Korneuburg-Bisamberg, Austria

[21] Appl. No.: 08/962,748

[22] Filed: Nov. 3, 1997

[30] Foreign Application Priority Data

Nov. 7, 1996 [AT] Austria ..... 1952/96

[51] Int. Cl.[6] ..... B25G 3/02

[52] U.S. Cl. ..... 403/364; 403/220; 403/229; 16/269

[58] Field of Search ..... 403/364, 119, 403/161, 162, 220, 291, 292, 294, 229; 108/167, 171, 77, 115; 16/269, 271, 268, 260; 220/847, 848, 844, 843, 845

[56] References Cited

U.S. PATENT DOCUMENTS

| | | | |
|---|---|---|---|
| 436,149 | 9/1890 | Overgaard | 403/364 X |
| 1,370,457 | 3/1921 | Linclon | 16/260 |
| 1,525,694 | 2/1925 | Sage et al. | 24/697.1 |
| 2,347,980 | 5/1944 | Apfelbaum | 220/844 |
| 2,462,373 | 2/1949 | Faure | 403/220 |
| 2,506,789 | 5/1950 | Hyde | 220/843 X |
| 3,462,181 | 8/1969 | Lewis | 403/364 |
| 3,836,217 | 9/1974 | Shiina | 403/364 X |
| 4,649,679 | 3/1987 | Arens | 403/364 X |
| 4,670,809 | 6/1987 | Teuber | 220/843 X |

*Primary Examiner*—Lynne H. Browne
*Assistant Examiner*—David E. Bochna
*Attorney, Agent, or Firm*—Henry M. Feiereisen

[57] ABSTRACT

A bracket for joining tables and/or table tops, includes a first bracket member adapted for attachment to one table or table top and having at least one hook-like projection, a second bracket member adapted for attachment to another table or table top to be joined and having at least two hook-like projections for so cooperating with the first bracket member that the projection of the first bracket member interlocks between the projections of the second bracket member. A connection element made of elastic and deformable material is placed between the projections of the first and second bracket members such that the projections of the first and second bracket members partially encompass the connection element, with the connection element generating a clamping force acting upon the projections of the first and second bracket members while being subject to an elastic deformation, thereby bracing the first and second bracket members with one another.

21 Claims, 3 Drawing Sheets

BRACKET FOR JOINING TABLES AND/OR TABLE TOPS

BACKGROUND OF THE INVENTION

The present invention generally refers to a bracket for joining tables or table tops, and more specifically to a bracket of a type having at least two bracket members for attachment to respective tables and/or table tops, and a connection element for joining the bracket members.

In general, only rigid brackets are utilized to join single desk tops for providing work stations with multiple work surfaces and thereby attempt to produce a stable, load-bearing, precise and lasting alignment of the tables in relation to one another. Lately, desks are increasingly designed for vertical adjustment. There are designs that propose a vertical adjustment of the entire table assembly, e.g. by means of a crank and a gearing. More common for reasons of reduced costs are however tables which have individually height-adjustable legs. This type of adjustment results however in temporary misalignment of the tables or table tops, causing i.a. stress upon the bracket. Furthermore, this type of height adjustment also leads to overextension of the brackets as a result of a mutual support of the bracket members and eventually to the formation of a gap between the tables or table tops.

As a consequence of their inherent elasticity, conventional brackets cannot be subject or only slightly to such loads. Thus, unless the height adjustment of the table assembly is effected in many small increments, or the brackets are removed altogether prior to adjustment, the applied loads will result in damage, buckling and ripping out of the screws etc.

Until now, the office furniture industry has given little attention to this problem because the height adjustment of tables necessitates substantial efforts or is difficult to handle and therefore of little use. On the other hand, effective and rapidly operating adjusting mechanisms are known which are, however, difficult to modify for effecting a useful and risk-free solution to the foregoing problems.

Conventional brackets are typically formed by simple metal sheets which are screwed to the underside across the interface of neighboring table tops to effect a precise positional and height alignment of the table tops relative to one another. In these types of brackets, when the table tops are tilted upwards, the metal sheets are stretched so that the screw fasteners are ripped out.

Another conventional method includes a secure attachment of supporting underframes of the table in various ways, whereby the table tops, which are supported by the underframes, are joined together without a direct connection. There is a risk however of ripping out and deforming the frame connection.

Still another conventional method proposes to attach stable load-carrying supports to the frames of main desks, with connection plates being directly secured to the supports. Also in this case, there is a risk of deformation and resultant gap formation of the table tops. Further constructions are known in the field of seminar tables which require temporary and reversible joining of table tops. Proposals include connections of tables with catches, clamps, hooks, latches, or the like, with some connections exhibiting a certain flexibility. However, additional manual manipulations are required to brace or loosen the connection, or a permanent play in the connection must be accepted.

It is further known to join table tops by means of piano straps, hinges, strap hinges and special fittings. These types of connections allow angular modifications up to a complete folding of the table tops, but usually only in one direction. Only when the edges of the table top are pointed and of triangular configuration is flexibility in both directions possible. However, such edges are expensive to manufacture and limit the universal use of office desks so that their application is not common in the area of standard office furniture.

Also known are so called swing door brackets. They permit angular changes of connected plates in both directions, however, they project on both sides beyond the plates so that their application as brackets is not possible for tables.

Conventional brackets are thus either generally unfit to compensate angular changes, or complex and expensive, demand much space and require recessed areas or casings, or are visible and adversely affect the look of the table surface. In any event, they are not specifically designed to carry out the necessary angle compensation during height adjustment of the table.

SUMMARY OF THE INVENTION

It is thus an object of the present invention to provide an improved bracket for joining tables and/or table tops, obviating the aforestated drawbacks.

In particular, it is an object of the present invention to provide an improved bracket which is of small structural dimensions so as to be invisible from the table top and prevented from interfering with the leg room of the user, and allows angular changes of joined table tops in both directions while still effecting an exact relative disposition of the table tops, without any risk of gap formation between the table tops.

It is still another object of the present invention, to provide an improved bracket which is of simple configuration and easy to manufacture while still being inexpensive and capable of absorbing high loads.

It is yet another object of the present invention, to provide an improved bracket which is durable and universally applicable and easy to mount to conventional tables having commonly used vertical edges of plastic material, without necessitating a refinishing of the edges.

These objects, and others will become apparent hereinafter, and are attained in accordance with the present invention by providing a bracket including a first bracket member adapted for attachment to one table or table top and having at least one hook-like projection, a second bracket member adapted for attachment to another table or table top to be joined and having at least two hook-like projections for so cooperating with the first bracket member that the projection of the first bracket member interlocks between the projections of the second bracket member, and a connection element made of elastic and deformable material for placement between the projections of the first and second bracket members such that the projections of the first and second bracket members partially encompass the connection element, with the connection element generating a clamping force acting upon the projections of the first and second bracket members while being subject to an elastic deformation, thereby bracing the first and second bracket members with one another.

Through the provision of a bracket according to the present invention, a height adjustment of joined tables and/or table tops is possible, without damaging the table tops or the bracket and without a need for clearing the tables prior to adjustment. The bracket includes basically only three components that can be made in an easy manner and thus inexpensively and does not require skilled personnel for installation. The bracket is also extremely flat so that the leg room under the table is not adversely affected; it provides a virtually flat underside, thus eliminating any risk of injury. In addition, the bracket is highly stress-resistant and simplifies the assembly of tables and/or table tops because after attachment of the one bracket member to the table, the other bracket member projecting outwards can serve as support for the adjoining table top.

Suitably, the projections of both bracket members can be designed to complement each other. In particular, the two bracket members can be made of identical design to allow interlocking engagement regardless of the positions of the bracket members. This simplifies the production and assembly of the bracket.

According to another feature of the present invention, both bracket members are designed in the shape of a plate exhibiting a flat support surface, with the projections being goosenecked in relation to the plane of the plate and having free ends extending essentially in alignment with the plane of the support surface. Thus, the bracket members can be made of flat material, with the free ends providing a support for a table top.

Alternatively, both bracket members can be designed as a flat plate having a planar support surface, with the free ends of the projections extending at a predetermined distance from the plane of the support surface. In this manner, the free ends can serve as support for a table top of a thickness that deviates from the thickness of the table top being joined by this distance.

Preferably, the free ends of the projections are wider than their mutual distance because the shear stress on the bracket is significantly reduced. In particular, it is advantageous to form the projections in the area of their free ends with laterally protruding flanges of rectangular configuration in order to effect a greatest possible reduction of the shear stress.

According to still another object of the present invention, the connection element can be designed as a rubber cord, with the width of the channel formed by the projections of the bracket members and the height of the projections being suited to the thickness of the rubber cord. In this manner, the rubber cord can not only placed in a simple manner between the projections by stretching the rubber cord to make it thinner, but the rubber cord can also be utilized for effecting a careful support of the table top.

Advantageously, the mutual distance between the projections of each bracket member is in the order of the thickness of the rubber cord so that the rubber cord remains essentially straightlined.

The mutual distance between the projections of each bracket member may however also be so designed as to significantly exceed the width of the projections, with the connection element being formed of flexible material, preferably of spring steel. This results in a simple design with relatively few projections.

The connection element may be formed of an evenly round cross section to allow use of a bendable flat material for making the projections. Alternatively, the connection element can exhibit an even rectangular or trapezoidal cross section to effect a wide support surface for a table top. Also, the connection element may be formed by a helical spring.

According to yet another feature of the present invention, the connection element is designed as a strip having a plurality of apertures of a size and disposition in correspondence to the size and disposition of the projections of the assembled bracket members. This design is especially advantageous when the bracket members are mounted with projections pointing away from the table top.

The connection element may further be made of several, preferably identical components which are placed either side-by-side and/or end-to-end, and essentially extend over the entire length of the connection element. This is advantageous when desiring relative great clamping forces, whereby the individual components of the connection element may, optionally, be attached sequentially. For ease of insertion, the connection element may be designed on both ends with a handle portion.

According to still another feature of the present invention, both bracket members may extend in assembled but not yet attached state at angle that differs from the actual position of installation.

BRIEF DESCRIPTION OF THE DRAWING

The above and other objects, features and advantages of the present invention in the following examples of preferred embodiments will now be described in more detail with reference to the accompanying drawings.

DETAILED DESCRIPTION OF PREFERRED EMBODIMENTS

Figure 1:
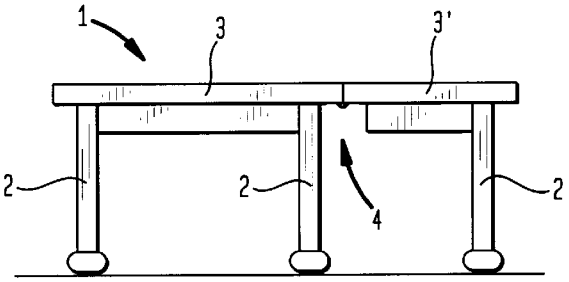
FIG. 1 is a schematic illustration an exemplified table with extension table in normal position and attached to one another by a bracket according to the present invention.

Throughout all the Figures, the same or corresponding elements are generally indicated by the same reference numerals.

Figure 1A:
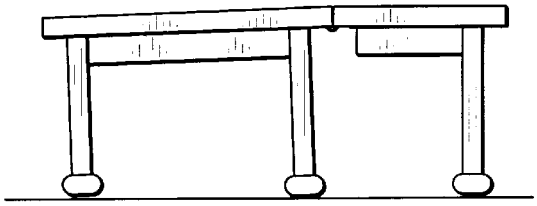
FIG. 1*a* is a schematic illustration of the table with attached extension table of FIG. 1 during height adjustment in one direction.
Figure 1B:
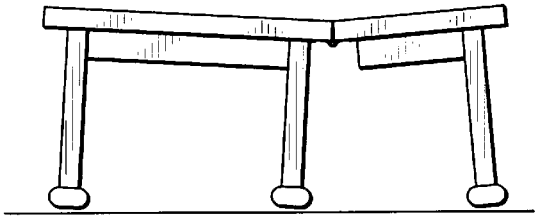
FIG. 1*b* is a schematic illustration of the table with attached extension table of FIG. 1 during height adjustment in an opposite direction.
Figure 6:
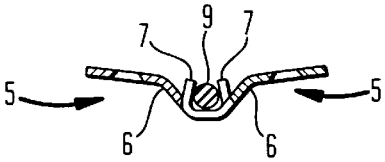
FIG. 6 is a sectional view of the bracket shown in FIG. 5.

Turning now to the drawing, and in particular to FIG. 1, there is shown a schematic illustration of an exemplified table configuration, generally designated by reference numeral 1 and including a table top 3 supported on the ground by height-adjustable legs 2 and an extension table top 3' also mounted on height-adjustable legs 2, with the table tops 3, 3' being secured to one another by a fitting or bracket in accordance with the present invention, generally designated by reference numeral 4. The table tops 3, 3' are shown in horizontal alignment to occupy their normal position, with the legs 2 extending in an area outside the area of attachment by the bracket 4. Schematically shown in FIGS. 1*a* and 1*b* are height-adjusted positions of the table top configuration 1, with the table top 3 being elevated, as shown in FIG. 1*a*, or lowered, as shown in FIG. 1*b*, through adjustment of the legs 2, whereby the table tops 3, 3' are tilted relative to one another to occupy position that pose the problems associated with conventional brackets.

Figure 2:
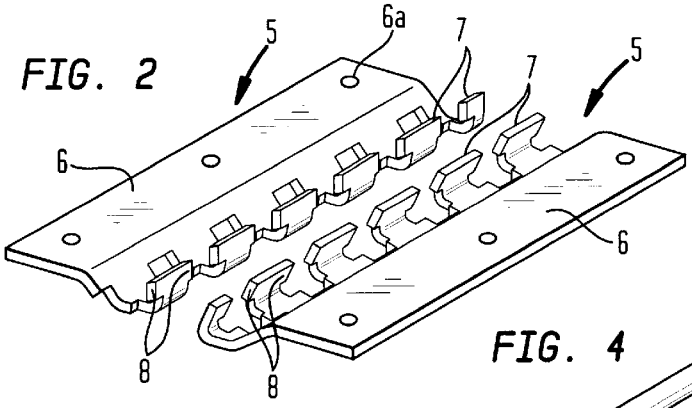
FIG. 2 is a front, top and side perspective view of a first embodiment of a bracket according to the present invention, in disassembled state.
Figure 7:
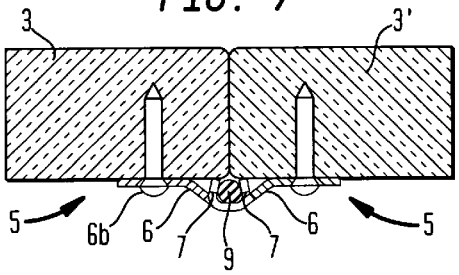
FIG. 7 is a sectional view of two adjoining table tops mounted together with a bracket according to the present invention, with the table tops being in horizontal alignment to occupy their normal position.
Figure 16:
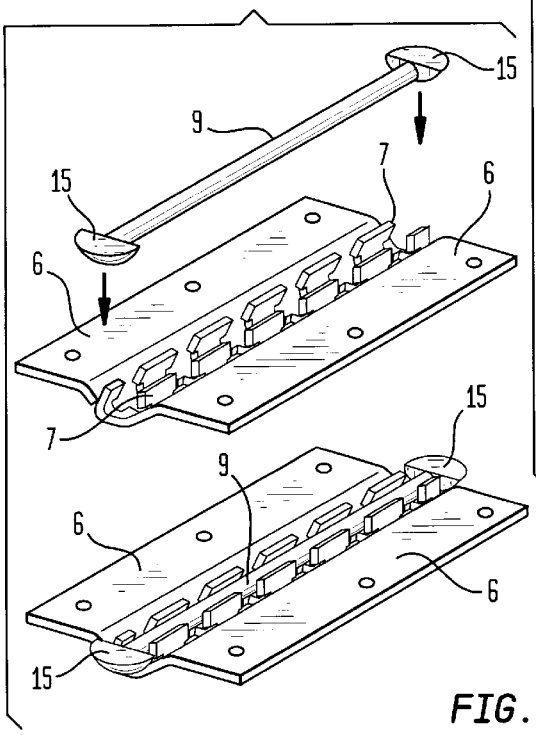
FIG. 16 is a front, top and side view of a bracket in partially assembled state, where the connection element has opposite ends formed with a handle portion.

Turning now to FIG. 2, there is shown an exploded perspective view of one embodiment of a bracket 4 in accordance with the present invention. The bracket 4 is formed by two bracket members 5 which are of identical design and extend along sections or over the entire length of abutting side edges of two table tops being joined to one another. As also seen in conjunction with FIG. 3, each of the bracket members 5 includes a plate 6 provided with several bores 6*a* for mounting thereof to the table top by means of suitable screw fasteners 6*b* (FIG. 7). The plate 6 is formed with a straightlined row of lateral hook-like projections 7 which are goosenecked with respect to the plane of the plate 6 (FIG. 16) and have free ends terminating in alignment with the support surface of the plate 6, facing the table top and slightly bent backwards.

Figure 3:
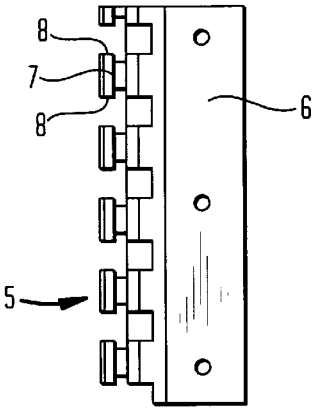
FIG. 3 is a top view of one bracket member of the bracket of FIG. 2.

The space between neighboring projections 7 corresponds to the width of projections 7 so that projections 7 of one of the bracket members 5 are able to engage between projections 7 of the other one of the bracket member 5 at slight clearance. As best seen in FIG. 3, the free ends of the projections 7 are formed with laterally protruding rectangular flanges 8 so that their free ends are wider than the distance between neighboring projections 7.

Figure 4:
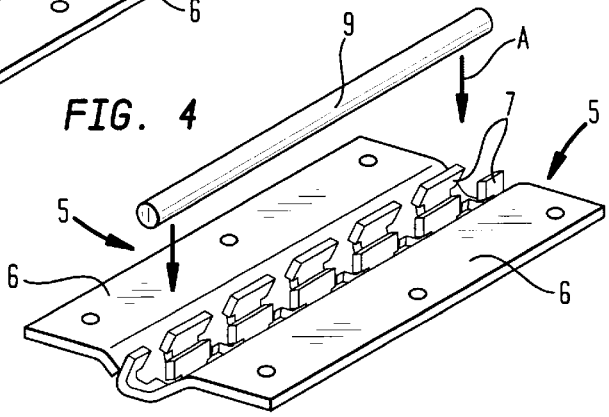
FIG. 4 is a front, top and side perspective view of the bracket in partially assembled state.

FIG. 4 shows a perspective view of the two bracket members 5 in engaged position by interlocking the projections 7 and subsequent shift of the projections 7 perpendicular to the plane of the plates 6. In the engaged position, the projections 7 of the bracket members 5 overlap one another in the form of a hinge so as to demarcate a straight channel therebetween. As a result of the interlocking flanges 8 of the projections 7 of both bracket members 5, the bracket members 5 are prevented from disengagement in the plate plane. Moreover, the flanges 8 limit the relative tilting range of both bracket members 5 by impacting on the plate 6.

Figure 5:
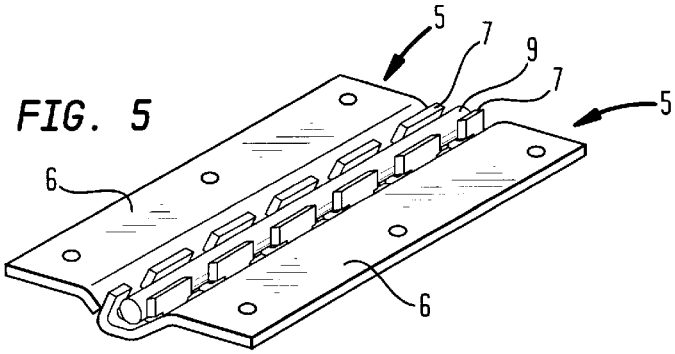
FIG. 5 is a front, top and side perspective view of the fully assembled bracket.

Received in the straight channel is a connection element 9 in the form of a rubber cord for joining the bracket members 5 by insertion in the direction of arrow A into the channel between the projections 7. The fully assembled state of the bracket 4 is shown in FIG. 5. The thickness of the rubber cord 9 corresponds to the width of the channel as well as to the vertical extension of the projections 7. However, the thickness of the rubber cord 9 slightly exceeds the width of the channel. As a result of a slightly greater thickness than the width of the channel, the rubber cord 9 when placed into the channel becomes elastically deformed to thereby exert a clamping force onto the projections 7 that tends to draw the bracket members 5 together. This action of drawing the bracket members 5 together is limited by the impact of the projections 7 of one bracket member 5 upon the base of the spaces formed between neighboring projections 7 of the other bracket member 5. The placement of the rubber cord 9 can be effected by pushing the rubber cord 9 into the channel whereby both bracket members 5 are suitably so pivoted to one another as to widen the channel to a greatest possible extent, or by stretching the rubber cord 9 in order to make it thinner. Suitably, the rubber cord 9 is formed with handle portions in the form of enlargements 15 (FIG. 16) or the like to facilitate the stretching operation, whereby the enlargements may also serve at the same time as end caps of the channel. Since the projections 7 are bent backwards, the rubber cord 9 is overlapped by the projections 7 and firmly lodged in place.

The rubber cord 9 is both, squeezed by the flanges 8 and also exposed to shear forces which are reduced, however, to a relatively small extent because the flanges 8 of both bracket members 5 oppose one another. As a consequence of the plurality of load areas, a considerable clamping force is effected for keeping the bracket members 5 together. The squeezed rubber cord 9 lodged between the interlocked projections 7 turns slightly sideways in a central area of the spaces between the projections 7 to thereby assume a sinusoidal curve. This deviation or curvature represents a third component of the resulting clamping force because of the tendency of the rubber cord 9 to return to its initial straight alignment.

The design of the bracket members 5 results in a small structural size and effects a flat bottom surface, without encountering protrusions and edges which are bothersome to the user.

As the free ends of the projections 7 extend essentially in alignment with the plane of the support surface of the plate 6, the free ends serve as contact area and support for the adjoining table top, as shown for example in FIG. 7 so that the table tops 3, 3' being joined are precisely leveled.

Figure 7A:
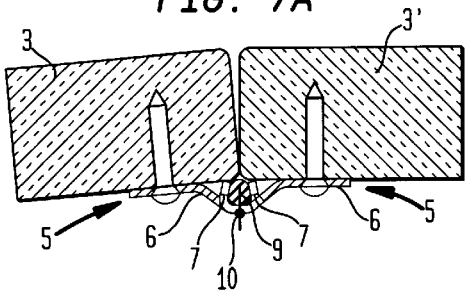
FIG. 7*a* is a sectional view of the table tops of FIG. 7 during height adjustment in one direction.

As shown in FIG. 7*a*, in the event, one of the table tops, e.g. table top 3, buckles downward during a height adjustment, both bracket members 5 are tilted relative to one another in the form of a hinge about an axis 10 extending along the interface of both bracket members 5 so that the bracket members 5 are pulled further apart, causing additional squeezing of the rubber cord 9 to thereby further increase the clamping force. The flanges 8, together with the rubber cord 9 lodged therebetween, are being pushed against one another to thereby limit the pivot angle so that the rubber cord 9 is not sheared off.

Figure 7B:
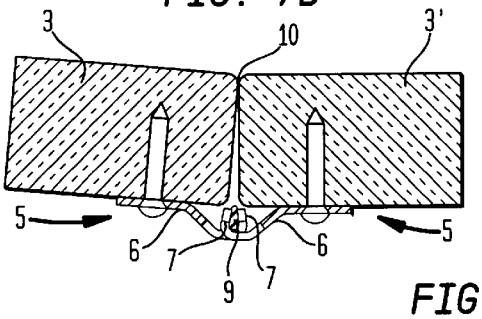
FIG. 7*b* is a sectional view of the table tops of FIG. 7 during height adjustment in opposite direction.

If, on the other hand, the table top 3 tilts upwardly during height adjustment, as illustrated in FIG. 7*b*, the pivot axis 10 extends along the interface at the upper edge of the table tops 3, 3' and thus at a distance to the bracket 4 so that both bracket members 5 are pulled apart, to further squeeze the rubber chord 9 and thereby further increase the clamping force. At the same time, the flanges 8 together with the incorporated rubber cord 9 are pushed together to thereby limit the pivot angle and to prevent a shearing off of the rubber cord 9.

The relatively small pivot range of both bracket members 5 is entirely sufficient for practical purposes. On the one hand, the tables can be vertically adjusted, without first clearing them so that more tilted or slanted positions are not purposeful; On the other hand, the maximal adjusting range of the table also constrains the angular range.

Assembly of the bracket 4 is effected by initially mounting one of the bracket members 5 to one table top, for example table top 3 so that the other bracket member 5 that juts outwards can provide support for the adjoining table top 3'. Subsequently, the other bracket member 5 is secured to the adjoining table top 3', with the plates 6 of both bracket members 5 being aligned in a common plane, thereby effecting an additional squeezing of the rubber cord 9 and thus a high clamping force in normal position.

Figure 8:
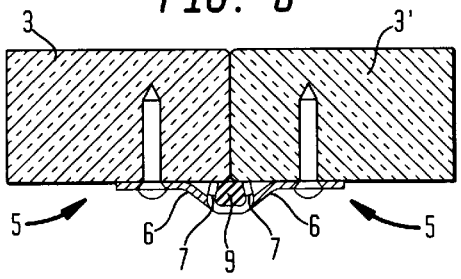
FIG. 8 is a sectional view of two adjoining table tops mounted together by a second embodiment of a bracket according to the present invention, with the table tops being in horizontal alignment to occupy their normal position.

Turning now to FIG. 8, there is shown a sectional view of a second embodiment of a bracket 4 according to the present invention for joining two table tops, with the difference to the bracket shown in FIGS. 2 to 6 residing in the configuration of the rubber cord. As shown in FIG. 8, the rubber cord 9 has a trapezoidal cross section and is greater in width than in height. This configuration allows production of a smaller bracket 4 while the projections 7 of both bracket members 5 are characterized by a greater mutual distance so that the pivot range is increased. Moreover, the table tops 3, 3' can be adjusted in height by the direct contact upon the rubber cord 9 so that the projections 7 are prevented from bearing upon the table tops 3, 3', eliminating damage through scratches. Also, the provision of a trapezoidal rubber cord 9 enables an increase of the clamping force compared to the round rubber cord of FIGS. 2 to 6, because there is no initial flattening as encountered in conjunction with a round cord.

Persons skilled in the art will understand that the rubber cord 9 may certainly be shaped in a configuration which differs from the trapezoidal cross section. For example, it is certainly within the scope of the present invention to provide the rubber cord of square or rectangular configuration.

In accordance with a variation of the embodiment of a bracket according to FIGS. 2 to 8, the projections 7 of one bracket member 5 may be formed with a goosenecked section that is greater than the goosenecked section of the other bracket member 5 to permit connection of table tops of different height and different thickness.

Figure 9:
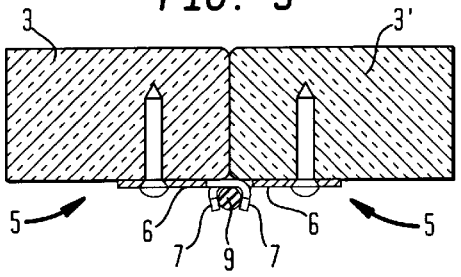
FIG. 9 is a sectional view of two adjoining table tops mounted together by a third embodiment of a bracket according to the present invention, with the table tops being in horizontal alignment to occupy their normal position.

Referring now to FIG. 9, there is shown a sectional view of a third embodiment of a bracket 4 according to the present invention for joining two table tops 3, 3', with the difference to the previous embodiments residing in the configuration of the projections 7. As shown in FIG. 9, the hook-like projections 7 are formed without goosenecked area but are simply bent away from the plate 6. This type of bracket 4 enables insertion or removal of the rubber cord 9 from below even after attachment of the bracket members 5 to the table tops 3, 3'. However, as the attainable clamping force is smaller, this type of bracket 4 is suitable primarily for a mobile or temporary attachment, e.g. to seminar tables. The vertical alignment of the table tops 3, 3' is effected through their support upon the back sides of the projections 7, extending in a same plane as the support surface of the plates 6.

Figure 13:
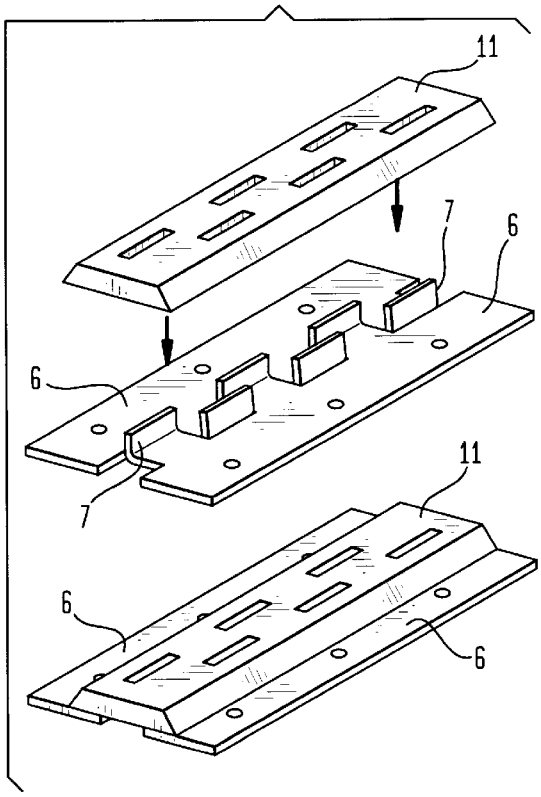
FIG. 13 is a front, top and side view of a bracket in partially assembled state, in which the connection element is a strip formed with a plurality of apertures.

As in the embodiment of the bracket 4 of FIG. 9, the projections 7 are exposed, it is suitable to configure the distance between neighboring projections 7 greater than their width and to form the connection element 9 as a strip 11 (FIG. 13) with a row of apertures of a size and disposition in correspondence to those of the projections 7 of the assembled bracket members 5. The thickness of the strip 9 suitably corresponds to the height of the projections 7 so that the projections 7 are enveloped by the strip. Furthermore, these apertures can be blind holes covering the projections 7.

Figure 12:
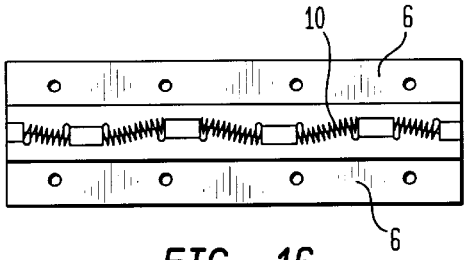
FIG. 12 is a top view of the connection element being a helical spring.

Persons skilled in the art will understand that the configuration of connection element 9 should not be limited to the design in the form of a rubber cord. For example, the connection element 9 may also be represented by a helical spring 10 (FIG. 12).

Figure 10:
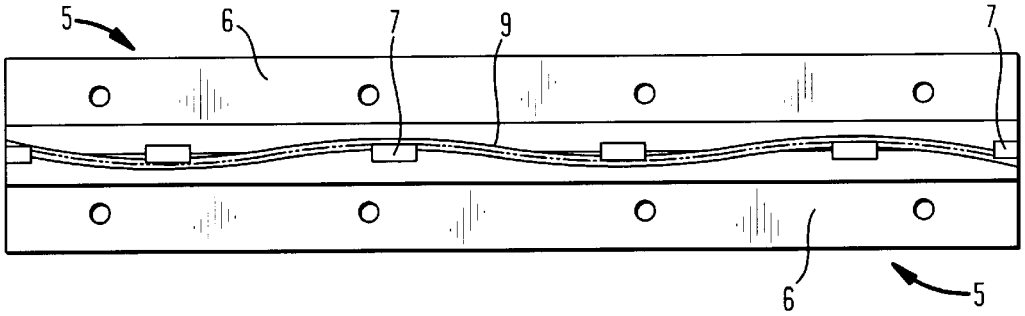
FIG. 10 is a top view of a fourth embodiment of a bracket according to the present invention.

FIG. 10 shows a further embodiment of a bracket 4 according to the present invention, including a connection element 9 in the form of a spring wire or spring band steel. In general, metal springs are normally subject to bending forces. Depending on the spring characteristics, the projections 7 can be arranged at greater distances from each other compared to the previously described configurations.

Figure 11:
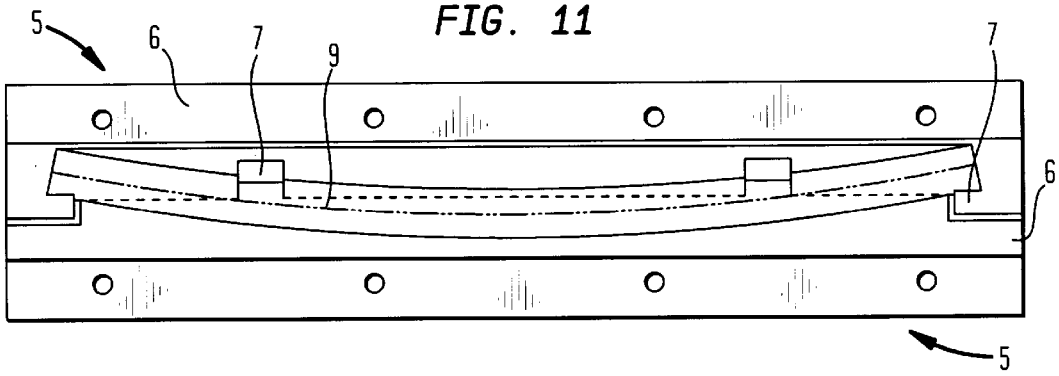
FIG. 11 is a top view of a fifth embodiment of a bracket according to the present invention.

Alternatively, the connection element 9 may be represented by a spring bar of metal of preferably elongated cross section, as shown in FIG. 11, with the spring bar being so prestressed as to form only a single arc. One of the bracket members 5 is formed with only two projections 7 spaced from one another by a considerable distance, and the other bracket member 5 has at least one projection 7, preferably however two projections 7, arranged between the two projections 7 of the one bracket member 5. This type of bracket permits a very flat design while still effecting highest possible clamping forces and great angular displacements, with the spring bar being subjected also to torsion stress.

The clamping force can also be increased by a greater spacing between the projections 7 of both bracket members 5, resulting in an increased amplitude of the sinusoidal curvature of the connection element 9. Also, a plurality of spring wires in parallel disposition or a bundle of spring wires of spring bands may be envisioned to allow a selection of the desired clamping force.

Figure 14:
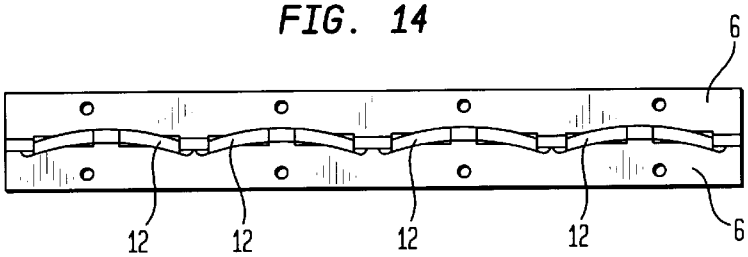
FIG. 14 is a top view of a sixth embodiment of the bracket according to the present invention.
Figure 15:
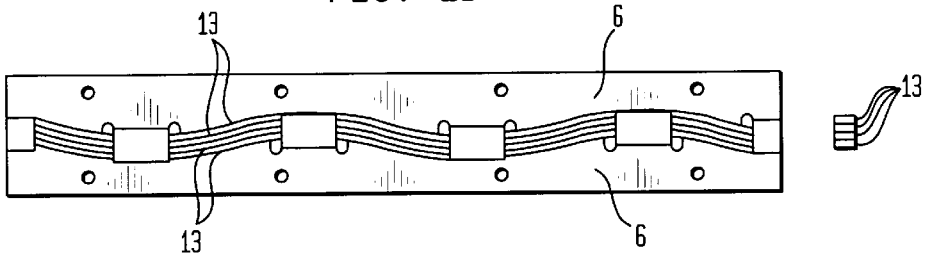
FIG. 15 is a top view of seventh embodiment of the bracket according to the present invention.

Furthermore, the connection elements 9 may be so provided with preformed arcs that the arcs 12 (FIG. 14), when loaded, are flattened and at best can be bent in opposite direction, thereby counteracting a shortening of the spring elements upon increasing arc amplitude. Also, the provision of several, short connection elements 9 in end-to-end disposition may be conceivable for incorporation in a very long bracket (FIGS. 14, 15).

While the invention has been illustrated and described as embodied in a bracket for joining tables and/or table tops, it is not intended to be limited to the details shown since various modifications and structural changes may be made without departing in any way from the spirit of the present invention.

What is claimed as new and desired to be protected by Letters Patent is set forth in the appended claims:

What is claimed is:

1. A bracket for joining tables or table tops, comprising:

a first bracket member adapted for attachment to one table or table top and having at least one hook-like projection;

a second bracket member adapted for attachment to another table or table top to be joined and having at least two hook-like projections for so cooperating with the first bracket member that the projection of the first bracket member interlocks between the projections of the second bracket member; and a connection element made of elastic and deformable material for placement between the projections of the first and second bracket members such that the projections of the first and second bracket members partially encompass the connection element, with the connection element generating a variable clamping force acting upon the projections of the first and second bracket members while being subject to an elastic deformation, thereby bracing the first and second bracket members with one another in a variable plane depending upon a vertical angle at which the tables or table tops are joined.

2. The bracket of claim 1 wherein the projection of the first bracket member and the projections of the second bracket members complement one another.

3. The bracket of claim 1 wherein the first and second bracket members are of identical configuration and interlock with one another in a form-fitting manner.

4. The bracket of claim 1 wherein each of the first and second bracket members includes a plate with a flat support surface, with the projection of the first bracket member and the projections of the second bracket member being goose-necked relative to the plate, and having free ends essentially in alignment with a plane of the support surface.

5. The bracket of claim 1 wherein each of the first and second bracket members includes a plate with a flat support surface, with the projection of the first bracket member and the projections of the second bracket member having free ends spaced from a plane of the support surface by a predetermined distance.

6. The bracket of claim 1 wherein the projections of the first and second bracket members having free ends which are wider than the distance of the projections from one another.

7. The bracket of claim 1 wherein the projections of the first and second bracket members have free ends and are formed with laterally protruding flanges in the area of their free ends.

8. The bracket of claim 1 wherein the connection element is provided in the form of a rubber cord, said projections of the first and second bracket members being defined by a height and forming together a channel of a width for receiving the rubber cord, said rubber cord having a thickness suited to the width of the channel and the height of the projections.

9. The bracket of claim 8 wherein the projections of the second bracket member are spaced from one another in the order of the thickness of the rubber cord.

10. The bracket of claim 1 wherein the projections of the second bracket member are spaced from one another at a distance which is greater than a width of the projections, said connection element being of flexible configuration.

11. The bracket of claim 10 wherein the connection element is a spring steel bar.

12. The bracket of claim 1 wherein the connection element has a round cross section.

13. The bracket of claim 1 wherein the connection element has a rectangular cross section.

14. The bracket of claim 1 wherein the connection element has a trapezoidal cross section.

15. The bracket of claim 1 wherein the connection element is a helical spring.

16. The bracket of claim 1 wherein the connection element is provided in the form of a strip formed with a plurality of apertures of a size and disposition corresponding to a size and disposition of the projections of the first and second bracket members in assembled state.

17. The bracket of claim 1 wherein the connection element is made from several components extending substantially over an entire length of the connection element.

18. The bracket of claim 17 wherein the components of the connection element are disposed side-by-side.

19. The bracket of claim 17 wherein the components of the connection element are formed with smooth ends in end-to-end disposition.

20. The bracket of claim 17 wherein the components are of identical configuration.

21. The bracket of claim 1 wherein the connection element has opposite ends formed with a handle portion.

* * * * *